United States Patent [19]

Davis et al.

[11] Patent Number: 4,623,473

[45] **Date of Patent: * Nov. 18, 1986**

[54] SULFUR-CONTAINING COMPOSITIONS, AND ADDITIVE CONCENTRATES AND LUBRICATING OILS CONTAINING SAME

[75] Inventors: Kirk E. Davis; Stephen A. DiBiase, both of Euclid, Ohio

[73] Assignee: The Lubrizol Corporation, Wickliffe, Ohio

[ * ] Notice: The portion of the term of this patent subsequent to Sep. 16, 2003 has been disclaimed.

[21] Appl. No.: 696,840

[22] Filed: Jan. 31, 1985

[51] Int. Cl.[4] ..... C10M 135/18; C10M 135/04

[52] U.S. Cl. ..... 252/33.6; 252/45

[58] Field of Search ..... 252/33.6, 45

[56] References Cited

U.S. PATENT DOCUMENTS

| | | | |
|---|---|---|---|
| Re. 27,331 | 4/1972 | Coleman | 252/45 |
| 2,265,851 | 12/1941 | Matheson | 252/48 |
| 2,394,536 | 2/1946 | Denison et al. | 252/33.6 |
| 2,703,784 | 3/1955 | Fields | 252/32.7 |
| 2,805,996 | 9/1957 | Degner | 252/33.6 |
| 2,850,453 | 9/1958 | Fields | 252/32.7 |
| 2,947,695 | 8/1960 | Leshin et al. | 252/33.6 |
| 2,999,813 | 9/1961 | Givens et al. | 252/33.6 |
| 3,221,056 | 11/1965 | Louthan | 260/583 |
| 3,419,614 | 12/1968 | Doss | 260/583 |
| 3,498,915 | 3/1970 | Coleman | 252/47.5 |
| 3,509,051 | 4/1970 | Farmer et al. | 252/33.6 |
| 3,632,566 | 1/1972 | Coleman | 252/45 |
| 3,663,561 | 5/1972 | Blaha | 260/302 SD |
| 4,098,705 | 7/1978 | Sakurai et al. | 252/33.6 |
| 4,140,643 | 2/1979 | Davis | 252/47.5 |
| 4,191,659 | 3/1980 | David | 252/45 |
| 4,360,438 | 11/1982 | Rowan et al. | 252/33.6 |
| 4,479,883 | 10/1984 | Shaub et al. | 252/33.6 |
| 4,487,706 | 11/1984 | Lam | 252/47 |

*Primary Examiner*—Jacqueline V. Howard

*Attorney, Agent, or Firm*—Karl Bozicevic; Denis A. Polyn; Walter C. Danison

[57] ABSTRACT

Sulfur-containing, oil-soluble compositions are described which are useful as lubricating oil additives, particularly in lubricants containing little or no phosphorus. In one embodiment, the compositions of the invention comprise (A) at least one metal salt of at least one dithiocarbamic acid of the formula $$R_1(R_2)N—CSSH \quad (I)$$

wherein $R_1$ and $R_2$ are each independently hydrocarbyl groups in which the total number of carbon atoms in $R_1$ and $R_2$ is sufficient to render the metal salt oil-soluble, and (B) at least one oil-soluble sulfurized Diels-Alder adduct. Lubricating oil compositions containing the compositions of the invention exhibit improved oxidation-corrosion-inhibiting properties, anti-wear properties, and/or extreme pressure properties. Such lubricating compositions containing less than about 0.1% by weight of phosphorus also exhibit good compatability with nitrile seals.

16 Claims, No Drawings

SULFUR-CONTAINING COMPOSITIONS, AND ADDITIVE CONCENTRATES AND LUBRICATING OILS CONTAINING SAME

TECHNICAL FIELD OF THE INVENTION

This invention relates to sulfur-containing compositions which are oil-soluble and which are useful as lubricating oil additives particularly in lubricants containing little or no phosphorus. More particularly, the present invention relates to lubricants containing little or no phosphorus and a composition comprising at least one metal dithiocarbamate and a sulfurized Diels-Alder adduct.

BACKGROUND OF THE INVENTION

Various compositions prepared by the sulfurization of olefins and olefin-containing compounds are known in the art, as are lubricants containing these products. Typical sulfurized compositions prepared by reacting olefins such as isobutene, diisobutene, and triisobutene with sulfur under various conditions are described in, for example, *Chemical Reviews,* 65, 237 (1965). Other references describe the reaction of such olefins with hydrogen sulfide to form predominantly mercaptans with sulfides, disulfides and higher polysulfides also being formed as by-products. Reference is made to *J. Am. Chem. Soc.,* 60, 2452 (1938), and U.S. Pat. No. 3,419,614. The patent describes a process for increasing the yield of mercaptan by carrying out the reaction of olefin with hydrogen sulfide and sulfur at a high temperature in the presence of various basic materials.

It also has been known that Diels-Alder adducts can be sulfurized to form sulfur-containing compositions which are particularly useful as extreme pressure and anti-wear additives in various lubricating oils. U.S. Pat. Nos. 3,632,566 and Re. 27,331 describe such sulfurized Diels-Alder adducts and lubricants containing said adducts. In these patents, the ratio of sulfur to Diels-Alder adduct is described as being a molar ratio of from about 0.5:1.0 to 10.0:1.0. The patents indicate that it is normally desirable to incorporate as much stable sulfur into the compound as possible, and therefore, a molar excess of sulfur normally is employed. The disclosed lubricating compositions may contain other additives normally used to improve the properties of lubricating compositions such as dispersants, detergents, extreme pressure agents, and additional oxidation and corrosion-inhibiting agents, etc. For some lubricant applications, however, the above-described sulfur-containing compositions have not been entirely adequate as multi-purpose additives.

Organophosphorus and metal organophosphorus compounds are used extensively in lubricating oils as extreme pressure agents and anti-wear agents. Examples of such compounds include: phosphosulfurized hydrocarbons such as the reaction product of a phosphorus sulfide with turpentine; phosphorus esters including dihydrocarbyl and trihydrocarbyl phosphites; and metal phosphorodithioates such as zinc dialkylphosphorodithioates. Because of the toxicological problems associated with the use of organophosphorus compounds, and particularly with the metal dialkylphosphorodithioates, there is a need to develop lubricant compositions containing low levels of phosphorus, yet characterized as having acceptable oxidation inhibition and anti-wear properties. Lubricants containing low levels of phosphorus also are desirable in view of the tendency of phosphorus to poison catalytic converters used to control emissions from gasoline engines.

Polyvalent metal salts of dithiocarbamic acids are known and have been described as being useful oil additives because they serve the dual function of sequestering undesirable metal components of the oil and because they function as anti-oxidants. Lubricating oil compositions have been described comprising combinations of various polyvalent metal dithiocarbamates with other chemical additives exhibiting desirable property-improving characteristics when added to the lubricating oil in combination with the dithiocarbamates. For example, U.S. Pat. No. 2,999,813 describes a lubricating composition comprising a sulfurized mineral oil and a polyvalent metal dithiocarbamate. Preferably, the composition also includes a lead soap of a naphthenic fatty acid. The preparation of lubricating compositions comprising mineral oil, metal salts of dithiocarbamic acids and coupling agents such as alcohols, esters, ketones and other stable oxygen-containing materials is described in U.S. Pat. No. 2,265,851. U.S. Pat. No. 2,394,536 describes lubricating oil compositions containing the combination of organic sulfides and salts of dithiocarbamic acids. Organic sulfides generally are represented by the formula $R_1(S)_nR_2$ wherein $R_1$ and $R_2$ are aliphatic groups and n is 1, 2 or 3.

U.S. Pat. No. 2,805,996 describes the use of amine-dithiocarbamate complexes in lubricating oil compositions, and U.S. Pat. No. 2,947,695 describes the advantages of utilizing mixtures of polyvalent metal dithiocarbamates in preparing oil-soluble additive compositions useful in the preparation of lubricating oils.

SUMMARY OF THE INVENTION

Oil-soluble compositions are described which comprise (A) at least one metal salt of at least one dithiocarbamic acid of the formula $$R_1(R_2)N—CSSH \quad (I)$$

wherein $R_1$ and $R_2$ are each independently hydrocarbyl groups in which the total number of carbon atoms in $R_1$ and $R_2$ is sufficient to render the metal salt oil-soluble, and (B) at least one oil-soluble sulfurized Diels-Alder adduct of at least one dienophile with at least one aliphatic conjugated diene.

The sulfurized Diels-Alder adduct generally is prepared by the reaction of sulfur and a Diels-Alder adduct in a molar ratio of from about 0.5:1 to about 10:1 wherein the adduct is an adduct of at least one dienophile with at least one aliphatic or alicyclic conjugated diene. Additive concentrates and lubricating oil compositions containing the oil-soluble compositions of the invention also are described. The oil-soluble compositions of the present invention are useful particularly in lubricating oil formulations which contain little or no phosphorus.

DETAILED DESCRIPTION OF THE PREFERRED EMBODIMENTS

Component (A) of the oil-soluble compositions of the invention is at least one metal salt of at least one dithiocarbamic acid of the formula $$R_1(R_2)N—CSSH \quad (I)$$

wherein $R_1$ and $R_2$ are each independently hydrocarbyl groups in which the total number of carbons in $R_1$ and $R_2$ is sufficient to render the metal salt oil-soluble. The hydrocarbyl groups $R_1$ and $R_2$ may be alkyl groups, cycloalkyl groups, aryl groups, alkaryl groups or aralkyl groups. $R_1$ and $R_2$, taken together, may represent the group consisting of polymethylene and alkyl-substituted polymethylene groups thereby forming a cyclic compound with the nitrogen. Generally, the alkyl group will contain at least two carbon atoms. The metal of the metal salt may be a monovalent metal or a polyvalent metal, although polyvalent metals are preferred since it is generally difficult to prepare oil solutions containing the desired quantities of the alkali metal salts. Suitable polyvalent metals include, for example, the alkaline earth metals, zinc, cadmium, magnesium, tin, molybdenum, iron, copper, nickel, cobalt, chromium, lead, etc. The Group II metals are preferred.

In selecting a metal salt of dithiocarbamic acid to be used in the oil-soluble compositions of the invention, $R_1$, $R_2$, and the metal may be varied so long as the metal salt is adequately oil-soluble. The nature and type of the mineral base stock, and the type of service contemplated for the treated lubricating oil are important modifying influences in the choice of metal salt.

Mixtures of metal salts of dithiocarbamic acids also are contemplated as being useful in the present invention. Such mixtures can be prepared by first preparing mixtures of dithiocarbamic acids and thereafter converting said acid mixtures to metal salts, or alternatively, metal salts of various dithiocarbamic acids can be prepared and thereafter mixed to give the desired product. Thus, the mixtures which can be incorporated in the compositions of the invention may be merely the physical mixture of the different metallic dithiocarbamic compounds or different dithiocarbamate groupings attached to the same polyvalent metal atom.

Examples of alkyl groups are ethyl, propyl, butyl, amyl, hexyl, heptyl, octyl, decyl, dodecyl, tridecyl, pentadecyl and hexadecyl groups including isomeric forms thereof. Examples of cycloalkyl groups include cyclohexyl and cycloheptyl groups, and examples of aralkyl groups include benzyl and phenylethyl. Examples of polymethylene groups include penta- and hexamethylene groups, and examples of alkyl-substituted polymethylene groups include methyl pentamethylene, dimethyl pentamethylene, etc.

Specific examples of the metal dithiocarbamates useful as component (A) in the compositions of this invention include zinc dibutyldithiocarbamate, zinc diamyldithiocarbamate, zinc di(2-ethylhexyl)dithiocarbamate, cadmium dibutyldithiocarbamate, cadmium dioctyldithiocarbamate, cadmium octyl-butyldithiocarbamate, magnesium dibutyldithiocarbamate, magnesium dioctyldithiocarbamate, cadmium dicetyldithiocarbamate, sodium diamyldithiocarbamate, sodium diisopropyldithiocarbamate, etc.

The various metal salts of dithiocarbamic acids utilized in the compositions of this invention are well known in the art and can be prepared by known techniques.

Component (B) of the oil-soluble compositions of the present invention comprises at least one oil-soluble sulfurized Diels-Alder adduct of at least one dienophile with at least one aliphatic conjugated diene. The sulfurized Diels-Alder adducts can be prepared by reacting various sulfurizing agents with the Diels-Alder adducts as described more fully below. Preferably, the sulfurizing agent is sulfur.

The Diels-Alder adducts are a well-known, art-recognized class of compounds prepared by the diene synthesis or Diels-Alder reaction. A summary of the prior art relating to this class of compounds is found in the Russian monograph, *Dienovyi Sintes,* Izdatelstwo Akademii Nauk SSSR, 1963 by A. S. Onischenko. (Translated into the English language by L. Mandel as A. S. Onischenko, *Diene Synthesis,* N.Y., Daniel Davey and Co., Inc. 1964.) This monograph and references cited therein are incorporated by reference into the present specification.

Basically, the diene synthesis (Diels-Alder reaction) involves the reaction of at least one conjugated diene, >C=C—C=C<, with at least one ethylenically or acetylenically unsaturated compound, >C=C< or —C=C—, these latter compounds being known as dienophiles. The reaction can be represented as follows:

Reaction 1

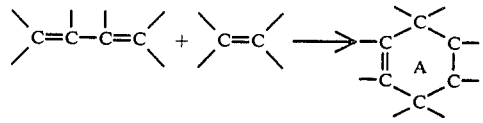

Reaction 2

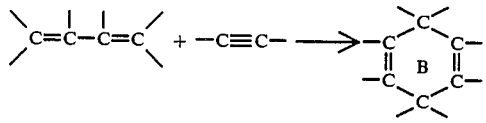

The products, A and B are commonly referred to as Diels-Alder adducts. It is these adducts which are used as starting materials for the preparation of the sulfurized Diels-Alder adducts utilized in the invention.

Representative examples of the 1,3-dienes include aliphatic and alicyclic conjugated diolefins or dienes of the formula

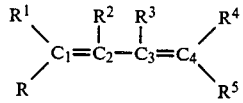

(II)

wherein R through $R^5$ are each independently selected from the group consisting of halogen, alkyl, halo, alkoxy, alkenyl, alkenyloxy, carboxy, cyano, amino, alkylamino, dialkylamino, phenyl, and phenyl-substituted with 1 to 3 substituents corresponding to R through $R^5$ with the proviso that a pair of R's on adjacent carbons do not form an additional double bond in the diene, or R, $R^2$, $R^3$ and $R^5$ are as defined and $R^1$ and $R^4$ are alkylene groups joined together to form a ring including the nitrogen atom. Preferably not more than three of the R variables are other than hydrogen and at least one is hydrogen. Normally the total carbon content of the diene will not exceed 20. In one preferred aspect of the invention, adducts are used where $R^2$ and $R^3$ are both hydrogen and at least one of the remaining R variables is also hydrogen. Preferably, the carbon content of these R variables when other than hydrogen is 7 or less. In this most preferred class, those dienes where R, $R^1$, $R^4$, and $R^5$ are hydrogen, chloro, or lower alkyl are especially useful. Specific examples of the R variables include the following groups: methyl, ethyl, phenyl, HOOC—, N≡C—, $CH_3O$—, $CH_3COO$—, $CH_3CH_2O$—, $CH_3C(O)$—, HC(O)—, Cl, Br, tert-butyl, $CF_3$, tolyl, etc. Piperylene, isoprene, methylisoprene, chloroprene, and 1,3-butadiene are among the preferred dienes for use in preparing the Diels-Alder adducts.

In addition to these linear 1,3-conjugated dienes, cyclic dienes are also useful as reactants in the formation of the Diels-Alder adducts. Examples of these cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclononatrienes. Various substituted derivatives of these compounds enter into the diene synthesis.

The dienophiles suitable for reacting with the above dienes to form the adducts used as reactants can be represented by the formula

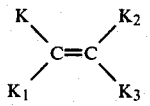

(III)

wherein the K variables are the same as the R variables in Formula II above with the proviso that a pair of K's may form an additional carbon-to-carbon bond, i.e., K—C≡C—$K_2$, but do not necessarily do so.

A preferred class of dienophiles are those wherein at least one of the K variables is selected from the class of electron-accepting groups such as formyl, cyano, nitro, carboxy, carbohydrocarbyloxy, hydrocarbylcarbonyl, hydrocarbylsulfonyl, carbamyl, acylcarbamyl, N-acyl-N-hydrocarbylcarbamyl, N-hydrocarbylcarbamyl, and N,N-dihydrocarbylcarbamyl. Those K variables which are not electron-accepting groups are hydrogen, hydrocarbyl, or substituted-hydrocarbyl groups. Usually the hydrocarbyl and substituted hydrocarbyl groups will not contain more than 10 carbon atoms each.

The hydrocarbyl groups present as N-hydrocarbyl substituents are preferably alkyl of 1 to 30 carbons and especially 1 to 10 carbons. Representative of this class of dienophiles are the following: nitroalkenes, e.g., 1-nitrobutene-1, 1-nitropentene-1, 3-methyl-1-nitrobutene-1, 1-nitroheptene-1, 1-nitrooctene-1, 4-ethoxy-1-nitrobutene-1; alpha, beta-ethylenically unsaturated aliphatic carboxylic acid esters, e.g., alkylacrylates and alpha-methyl alkylacrylates (i.e., alkyl methacrylates) such as butylacrylate and butylmethacrylate, decyl acrylate and decylmethacrylate, di-(n-butyl)maleate, di-(t-butyl-maleate); acrylonitrile, methacrylonitrile, beta-nitrostyrene, methylvinylsulfone, acrolein, acrylic acid; alpha, beta-ethylenically unsaturated aliphatic carboxylic acid amides, e.g., acrylamide, N,N-dibutylacrylamide, methacrylamide, N-dodecylmethacrylamide, N-pentylcrotonamide; crotonaldehyde, crotonic acid, beta, beta-dimethyldivinylketone, methyl-vinylketone, N-vinyl pyrrolidone, alkenyl halides, and the like.

One preferred class of dienophiles are those wherein at least one, but not more than two of K variables is —C(O)O—$R_o$ where $R_o$ is the residue of a saturated aliphatic alcohol of up to about 40 carbon atoms; e.g., for example at least one K is carbohydrocarbyloxy such as carboethoxy, carbobutoxy, etc., the aliphatic alcohol from which —$R_o$ is derived can be a mono or polyhydric alcohol such as alkyleneglycols, alkanols, aminoalkanols, alkoxy-substituted alkanols, ethanol, ethoxy ethanol, propanol, beta-diethylaminoethanol, dodecyl alcohol, diethylene glycol, tripropylene glycol, tetrabutylene glycol, hexanol, octanol, isooctyl alcohol, and the like. In this especially preferred class of dienophiles, not more than two K variables will be —C(O)—O—$R_o$ groups and the remaining K variables will be hydrogen or lower alkyl, e.g., methyl, ethyl, propyl, isopropyl, and the like.

Specific examples of dienophiles of the type discussed above are those wherein at least one of the K variables is one of the following groups: hydrogen, methyl, ethyl, phenyl, HOOC—, HC(O)—, $CH_2$=CH—, HC≡C—, $CH_3C(O)O$—, $ClCH_2$—, $HOCH_2$—, alpha-pyridyl, —$NO_2$, Cl, Br, propyl, iso-butyl, etc.

In addition to the ethylenically unsaturated dienophiles, there are many useful acetylenically unsaturated dienophiles such as propiolaldehyde, methylethynylketone, propylethynylketone, propenylethynylketone, propiolic acid, propiolic acid nitrile, ethylpropiolate, tetrolic acid, propargylaldehyde, acetylenedicarboxylic acid, the dimethyl ester of acetylenedicarboxylic acid, dibenzoylacetylene, and the like.

Cyclic dienophiles include cyclopentenedione, coumarin, 3-cyanocoumarin, dimethyl maleic anhydride, 3,6-endomethylene-cyclohexenedicarboxylic acid, etc. With the exception of the unsaturated dicarboxylic anhydrides derived from linear dicarboxylic acids (e.g., maleic anhydride, methylmaleic anhydride, chloromaleic anhydride), this class of cyclic dienophiles are limited in commercial usefulness due to their limited availability and other economic considerations.

The reaction products of these dienes and dienophiles correspond to the general formulae

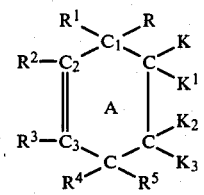

(IV)

and

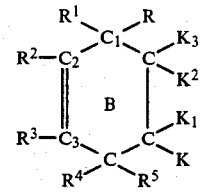

wherein R through $R^5$ and K through $K_3$ are as defined hereinbefore. If the dienophile moiety entering into the reaction is acetylenic rather than ethylenic, two of the K variables, one from each carbon, form another carbon-to-carbon double bond. Where the diene and/or the dienophile is itself cyclic, the adduct obviously will be bicyclic, tricyclic, fused, etc., as exemplified below:

Reaction 3

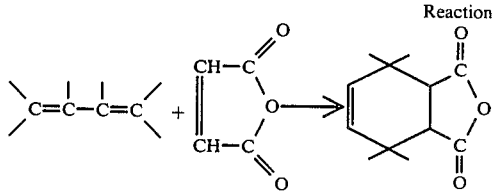

Reaction 4

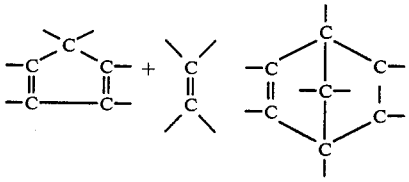

Normally, the adducts involve the reaction of equimolar amounts of diene and dienophile. However, if the dienophile has more than one ethylenic linkage, it is possible for additional diene to react if present in the reaction mixture.

The adducts and processes of preparing the adducts are further exemplified by the following examples. Unless otherwise indicated in these examples and in other parts of this specification, as well as in the appended claims, all parts and percentages are by weight.

EXAMPLE A

A mixture comprising 400 parts of toluene and 66.7 parts of aluminum chloride is charged to a two-liter flask fitted with a stirrer, nitrogen inlet tube, and a solid carbon dioxide-cooled reflux condenser. A second mixture comprising 640 parts (5 moles) of butyl acrylate and 240.8 parts of toluene is added to the $AlCl_3$ slurry while maintaining the temperature within the range of 37°-58° C. over a 0.25-hour period. Thereafter, 313 parts (5.8 moles) of butadiene is added to the slurry over a 2.75-hour period while maintaining the temperature of the reaction mass at 50°-61° C. by means of external cooling. The reaction mass is blown with nitrogen for about 0.33 hour and then transferred to a four-liter separatory funnel and washed with a solution of 150 parts of concentrated hydrochloric acid in 1100 parts of water. Thereafter, the product is subjected to two additional water washings using 1000 parts of water for each wash. The washed reaction product is subsequently distilled to remove unreacted butyl acrylate and toluene. The residue of this first distillation step is subjected to further distillation at a pressure of 9-10 millimeters of mercury whereupon 785 parts of the desired product is collected over the temperature of 105°-115° C.

EXAMPLE B

The adduct of isoprene and acrylonitrile is prepared by mixing 136 parts of isoprene, 106 parts of acrylonitrile, and 0.5 parts of hydroquinone (polymerization inhibitor) in a rocking autoclave and thereafter heating for 16 hours at a temperature within the range of 130°-140° C. The autoclave is vented and the contents decanted thereby producing 240 parts of a light yellow liquid. This liquid is stripped at a temperature of 90° C. and a pressure of 10 millimeters of mercury thereby yielding the desired liquid product as the residue.

EXAMPLE C

Using the procedure of Example B, 136 parts of isoprene, 172 parts of methyl acrylate, and 0.9 part of hydroquinone are converted to the isoprenemethyl acrylate adduct.

EXAMPLE D

Following the procedure of Example B, 104 parts of liquified butadiene, 166 parts of methyl acrylate, and 1 part of hydroquinone are charged to the rocking autoclave and heated to 130°-135° C. for 14 hours. The product is subsequently decanted and stripped yielding 237 parts of the adduct.

EXAMPLE E

The adduct of isoprene and methyl methacrylate is prepared by reacting 745 parts of isoprene with 1095 parts of methyl methacrylate in the presence of 5.4 parts of hydroquinone in the rocking autoclave following the procedure of Example B above. 1490 parts of the adduct is recovered.

EXAMPLE F

The adduct of butadiene and dibutyl maleate (810 parts) is prepared by reacting 915 parts of dibutyl maleate, 216 parts of liquified butadiene, and 3.4 parts of hydroquinone in the rocking autoclave according to the technique of Example B.

EXAMPLE G

A reaction mixture comprising 378 parts of butadiene, 778 parts of N-vinylpyrrolidone, and 3.5 parts of hydroquinone is added to a rocking autoclave previously chilled to −35° C. The autoclave is then heated to a temperature of 130°-140° C. for about 15 hours. After venting, decanting, and stripping the reaction mass, 75 parts of the desired adduct are obtained.

EXAMPLE H

Following the technique of Example B, 270 parts of liquified butadiene, 1060 parts of isodecyl acrylate, and 4 parts of hydroquinone are reacted in the rocking autoclave at a temperature of 130°-140° C. for about 11 hours. After decanting and stripping, 1136 parts of the adduct are recovered.

EXAMPLE I

Following the same general procedure of Example A, 132 parts (2 moles) of cyclopentadiene, 256 parts (2 moles) of butyl acrylate, and 12.8 parts of aluminum chloride are reacted to produce the desired adduct. The butyl acrylate and the aluminum chloride are first added to a two-liter flask fitted with stirrer and reflux condenser. While heating the reaction mass to a temperature within the range of 59°-52° C., the cyclopentadiene is added to the flask over a 0.5-hour period. Thereafter the reaction mass is heated for about 7.5 hours at a temperature of 95°-100° C. The product is washed with a solution containing 400 parts of water and 100 parts of concentrated hydrochloric acid and the aqueous layer is discarded. Thereafter, 1500 parts of benzene are added to the reaction mass and the benzene solution is washed with 300 parts of water and the aqueous phase removed. The benzene is removed by distillation and the residue stripped at 0.2 parts of mercury to recover the adduct as a distillate.

EXAMPLE J

Following the technique of Example B, the adduct of butadiene and allylchloride is prepared using two moles of each reactant.

EXAMPLE K

One-hundred thirty-nine parts (1 mole) of the adduct of butadiene and methyl acrylate is transesterified with 158 parts (1 mole) of decyl alcohol. The reactants are added to a reaction flask and 3 parts of sodium methoxide are added. Thereafter, the reaction mixture is heated at a temperature of 190°-200° C. for a period of 7 hours. The reaction mass is washed with a 10% sodium hydroxide solution and then 250 parts of naphtha is added. The naphtha solution is washed with water. At the completion of the washing, 150 parts of toluene are added and the reaction mass is stripped at 150° C. under pressure of 28 parts of mercury. A dark-brown fluid product (225 parts) is recovered. This product is fractionated under reduced pressure resulting in the recovery of 178 parts of the product boiling in the range of 130°-133° C. at a pressure of 0.45 to 0.6 parts of mercury.

EXAMPLE L

The general procedure of Example A is repeated except that only 270 parts (5 moles) of butadiene is included in the reaction mixture.

The sulfur-containing compounds of the present invention are readily prepared by heating a mixture of a sulfurizing agent such as sulfur, and at least one of the Diels-Alder adducts of the types discussed hereinabove at a temperature within the range of from about 110° C. to just below the decomposition temperature of the Diels-Alder adducts. Temperatures within the range of about 110° to about 200° C. will normally be used. This reaction results in a mixture of products, some of which have been identified. In the compounds of known structure, the sulfur reacts with the substituted unsaturated cycloaliphatic reactants at a double bond in the nucleus of the unsaturated reactant.

The molar ratio of sulfur to Diels-Alder adduct used in the preparation of the sulfur-containing composition is from about 0.5:1 to about 10:1 although the molar ratio generally will be less than about 4:1. In one embodiment of the invention, the molar ratio is less than about 1.7:1 and more preferably less than about 1:1.

The sulfurizing reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

As hydrogen sulfide is an undesirable contaminent, it is advantageous to employ standard procedures for assisting in the removal of the $H_2S$ from the products. Blowing with steam, alcohols, air, or nitrogen gas assists in the removal of $H_2S$ as does heating at reduced pressures with or without the blowing.

It is sometimes advantageous to incorporate materials useful as sulfurization catalysts in the reaction mixture. These materials may be acidic, basic or neutral. Useful neutral and acidic materials include acidified clays such as "Super Filtrol", p-toluenesulfonic acid, dialkylphosphorodithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1-20 carbon atoms. Suitable amines include aniline, benzylamine, dibenzylamine, dodecylamine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The preferred basic catalysts include ammonia and primary, secondary, or tertiary alkylamines having about 1-8 carbon atoms in the alkyl radicals. Representative amines of this type are methylamine, dimethylamine, trimethylamine, ethylamine, diethylamine, triethylamine, di-n-butylamine, tri-n-butylamine, tri-sec-hexylamine and tri-n-octylamine. Mixtures of these amines can be used, as well as mixtures of ammonia and amines.

When a catalyst is used, the amount is generally about 0.05-2.0% of the weight of the adduct.

The following examples illustrate the preparation of the novel sulfur-containing compounds useful in the present invention.

EXAMPLE I

To 255 parts (1.65 moles) of the isoprenemethacrylate adduct of Example C heated to a temperature of 110°-120° C., there are added 53 parts (1.65 moles) of sulfur flowers over a 45-minute period. The heating is continued for 4.5 hours at a temperature in the range of 130°-160° C. After cooling to room temperature, the reaction mixture is filtered through a medium sintered glass funnel. The filtrate consists of 301 parts of the desired sulfur-containing products.

EXAMPLE II

A reaction mixture comprising 1175 parts (6 moles) of the Diels-Alder adduct of butyl acrylate and isoprene and 192 parts (6 moles) of sulfur flowers is heated for 0.5 hour at 108°-110° C. and then to 155°-165° C. for 6 hours while bubbling nitrogen gas through the reaction mixture at 0.25 to 0.5 standard cubic feet per hour. At the end of the heating period, the reaction mixture is allowed to cool and filtered at room temperature. Thereafter, the product is permitted to stand for 24 hours and refiltered. The filtrate is the desired product.

EXAMPLE III

Sulfur (4.5 moles) and the adduct of isoprene-methyl methacrylate (4.5 moles) are mixed at room temperature and heated for one hour at 110° C. while blowing nitrogen through the reaction mass at 0.25-0.5 standard cubic feet per hour. Subsequently the reaction mixture is raised to a temperature of 150°-155° C. for 6 hours while maintaining the nitrogen blowing. After heating, the reaction mass is permitted to stand for several hours while cooling to room temperature and is thereafter filtered. The filtrate consists of 842 parts of the desired sulfur-containing product.

EXAMPLE IV

A one-liter flask fitted with a stirrer, reflux, condenser, and nitrogen inlet line is charged with 256 parts (1 mole) of the adduct of butadiene and isodecyl acrylate, and 51 grams (1.6 moles) of sulfur flowers and then heated for 12 hours at a temperature, stand for 21 hours, and filtered at room temperature to produce the desired product as the filtrate.

EXAMPLE V

A mixture of 1703 parts (9.4 moles) of a butyl acrylate-butadiene adduct prepared as in Example L, 280 parts (8.8 moles) of sulfur and 17 parts of triphenyl phosphite is prepared in a reaction vessel and heated gradually over 2 hours to a temperature of about 185° C. while stirring and sweeping with nitrogen. The reaction is exothermic near 160°-170° C., and the mixture is maintained at about 185° C. for 3 hours. The mixture is cooled to 90° C. over a period of 2 hours and filtered using a filter aid. The filtrate is the desired product containing 14.0% sulfur.

EXAMPLE VI

The procedure of Example V is repeated except that the triphenyl phosphite is omitted from the reaction mixture.

EXAMPLE VII

The procedure of Example V is repeated except that the triphenyl phosphite is replaced by 2.0 parts of triamyl amine as a sulfurization catalyst.

EXAMPLE VIII

A mixture of 547 parts of a butyl acrylatebutadiene adduct prepared as in Example L and 5.5 parts of triphenyl phosphite is prepared in a reaction vessel and heated with stirring to a temperature of about 50° C. whereupon 94 parts of sulfur are added over a period of 30 minutes. The mixture is heated to 150° C. in 3 hours while sweeping with nitrogen. The mixture then is heated to about 185° C. in approximately one hour. The reaction is exothermic and the temperature is maintained at about 185° C. by using a cold water jacket for a period of about 5 hours. At this time, the contents of the reaction vessel are cooled to 85° C. and 33 parts of mineral oil are added. The mixture is filtered at this temperature, and the filtrate is the desired product wherein the sulfur to adduct ratio is 0.98/1.

EXAMPLE IX

The general procedure of Example VIII with the exception that the triphenyl phosphite is not included in the reaction mixture.

EXAMPLE X

A mixture of 500 parts (2.7 moles) of a butyl acrylate-butadiene adduct prepared as in Example L and 109 parts (3.43 moles) of sulfur is prepared and heated to 180° C. and maintained at a temperature of about 180°-190° C. for about 6.5 hours. The mixture is cooled while sweeping with a nitrogen gas to remove hydrogen sulfide odor. The reaction mixture is filtered and the filtrate is the desired product containing 15.8% sulfur.

EXAMPLE XI

A mixture of 728 parts (4.0 moles) of a butyl acrylate-butadiene adduct prepared as in Example L, 218 parts (6.8 moles) of sulfur, and 7 parts of triphenyl phosphite is prepared and heated with stirring to a temperature of about 181° C. over a period of 1.3 hours. The mixture is maintained under a nitrogen purge at a temperature of 181°-187° C. for 3 hours. After allowing the material to cool to about 85° C. over a period of 1.4 hours, the mixture is filtered using a filter aid, and the filtrate is the desired product containing 23.1% sulfur.

EXAMPLE XII

A mixture of 910 parts (5 moles) of a butyl acrylate-butadiene adduct prepared as in Example L, 208 parts (6.5 moles) of sulfur and 9 parts of triphenyl phosphite is prepared and heated with stirring and nitrogen sweeping to a temperature of about 140° C. over 1.3 hours. The heating is continued to raise the temperature to 187° C. over 1.5 hours, and the material is held at 183°-187° C. for 3.2 hours. After cooling the mixture to 89° C., the mixture is filtered with a filter aid, and the filtrate is the desired product containing 18.2% sulfur.

EXAMPLE XIII

A mixture of 910 parts (5 moles) of a butyl acrylate-butadiene adduct prepared as in Example L, 128 parts (4 moles) of sulfur and 9 parts of triphenyl phosphite is prepared and heated with stirring while sweeping with nitrogen to a temperature of 142° C. over a period of about one hour. The heating is continued to raise the temperature to 185°-186° C. over about 2 hours and the mixture is maintained at 185°-187° C. for 3.2 hours. After allowing the reaction mixture to cool to 96° C., the mixture is filtered with filter aid, and the filtrate is the desired product containing 12.0% sulfur.

EXAMPLE XIV

The general procedure of Example XIII is repeated except that the mixture contain 259 parts (8.09 moles) of sulfur. The product obtained in this manner contains 21.7% sulfur.

EXAMPLE XV

A reaction mixture comprising 1175 grams (6 moles) of the Diels-Alder adduct of butylacrylate and isoprene and 384 grams (12 moles) of sulfur flowers is heated for 0.5 hour at 1.08°-110° C. and then to 155°-165° for 6 hours while bubbling nitrogen gas through the reaction mixture at 0.25 to 0.5 standard cubic feet per hour. At the end of the heating period, the reaction mixture is allowed to cool and filtered at room temperature. Thereafter, the product is permitted to stand for 24 hours and refiltered. The filtrate weighing 1278 grams is the desired product.

EXAMPLES XVI-XX

Examples XVI through XX illustrate the preparation of other sulfur-containing compounds useful in the present invention. In each case, the adduct and the sulfur are mixed in a reaction flask and thereafter heated to a temperature within the range of 150°-160° C. for a period of 7 to 10 hours while bubbling nitrogen through the reaction mixture. The sulfurized products are then permitted to cool to room temperature and allowed to stand for several hours. Thereafter the reaction mass is filtered, the filtrate representing the desired sulfur-containing products.

| | Adduct of Example | Molar Ratio of Sulfur to Adduct |
|---|---|---|
| XVI | 3 | 2:1 |
| XVII | 2 | 2:1 |
| XVIII | 10 | 4:1 |
| XIX | 8 | 4:1 |
| XX | 11 | 5:1 |

It has been found that, if the sulfur-containing products of this invention are treated with an aqueous solution of sodium sulfide containing from about 5% to about 75% by weight $Na_2S$, the treated product may exhibit less of a tendency to darken freshly polished copper metal.

Treatment involves the mixing together of the sulfurized reaction product and the sodium sulfide solution for a period of time sufficient for any unreacted sulfur to be scavenged, usually a period of a few minutes to several hours depending on the amount of unreacted sulfur, the quantity and the concentration of the sodium sulfide solution. The temperature is not critical but normally will be in the range of about 20° C. to about 100° C. After the treatment, the resulting aqueous phase is separated from the organic phase by conventional techniques, i.e., decantation, etc. Other alkali metal sulfides, $M_2S_x$ where M is an alkali metal and x is 1,2, or 3 may be used to scavenge unreacted sulfur but those where x is greater than 1 are not nearly as effective. Sodium sulfide solutions are preferred for reasons of economy and effectiveness. This procedure is described in more detail in U.S. Pat. No. 3,498,915.

It has also been determined that treatment of the reaction products with solid, insoluble acidic materials such as acidified clays or acidic resins and thereafter filtering the sulfurized reaction mass improves the product with respect to its color and solubility characteristics. Such treatment comprises thoroughly mixing the reaction mixture with from about 0.1% to about 10% by weight of the solid acidic material at a temperature of about 25°-150° C. and subsequently filtering the product.

As previously mentioned, there is no need to separate the sulfur-containing products which are produced in the above reactions. The reaction product is a mixture which comprises the compounds whose structures have been ascertained but which also comprises compounds whose structures are unknown. Since it is economically unfeasible to separate the components of the reaction mixture, they are employed in combination as a mixture of sulfur-containing compounds.

In order to remove the last traces of impurities from the reaction mixture, particularly when the adduct employed was prepared using a Lewis acid catalyst, (e.g., $AlCl_3$) it is sometimes desirable to add an organic inert solvent to the liquid reaction product and, after thorough mixing, to refilter the material. Subsequently the solvent is stripped from the product. Suitable solvents include solvents of the type mentioned hereinabove such as benzene, toluene, the higher alkanes, etc. A particularly useful class of solvents are the textile spirits.

In addition, other conventional purification techniques can be advantageously employed in purifying sulfurized products used in this invention. For example, commercial filter aids can be added to the materials prior to filtration to increase the efficiency of the filtration. Filtering through diatomaceous earth is particularly useful where the use contemplated requires the removal of substantially all solid materials. However, such expedients are well known to those skilled in the art and require no elaborate discussion herein.

The relative amounts of the metal salts of dithiocarbamic acid (component (A)) and the sulfurized Diels-Alder adduct (component (B)) may vary over a wide range depending upon the intended use of the composition. Generally, the weight ratio of metal salt (A) to sulfurized adduct (B) is within the range of from about 1:10 to about 50:1. The precise amounts of the two components to be included in the compositions of the invention can be readily determined by one skilled in the art.

The compositions of the present invention comprising components (A) and (B) are useful in lubricating oil compositions. The compositions of the invention can be added directly to the lubricant. Preferably, however, they are diluted with a substantially inert, normally liquid organic diluent such as mineral oil, naphtha, benzene, toluene or xylene, to form an additive concentrate. These concentrates usually contain from about 20% to about 90% by weight of the compositions of this invention and may contain, in addition, one or more other additives known in the art and described below. The remainder of the concentrate is the substantially inert normally liquid diluent.

The compositions of the invention are useful for improving the properties of lubricants containing little or no phosphorus, especially lubricants containing less than 0.1% phosphorus. In such low phosphorus lubricants, it is preferred to use a sulfurized Diels-Alder adduct (component (B)) prepared by reacting sulfur with an adduct in a mole ratio of less than 1:1.

The lubricating oil compositions of the present invention comprise a major amount of oil of lubricating viscosity, including natural and synthetic lubricating oils and mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene, copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification, process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The compositions of the present invention will normally be employed in the lubricating composition of the invention in an amount sufficient to provide the desired improvement in properties such as improved oxidation-corrosion-inhibition, anti-wear and/or extreme pressure properties. More generally, this amount will be from about 0.001% to about 20% by weight of the particular oil in which they are utilized. The optimum amount to be used in a given lubricant obviously would depend on the other contents of the particular lubricating composition, the operating conditions to which it is to be subjected, and the particular additives employed. In lubricating compositions operated under extremely adverse conditions, such as lubricating compositions for marine diesel engines, the compositions may be present in the lubricant in amounts of up to about 30% by weight, or more, of the total weight of the lubricating composition.

In one preferred embodiment, the lubricating oil compositions will comprise an oil of lubricating viscosity and components (A) and (B) as described above. The invention also contemplates the use of other additives in the lubricant compositions of this invention. Such additives are those normally used in lubricating oils such as, for example, detergents, dispersants, oxidation-inhibiting agents, pour point depressing agents, extreme pressure agents, antiwear agents, color stabilizers and antifoam agents.

Auxiliary extreme pressure agents and corrosion- and oxidation-inhibiting agents which may be included in the lubricants of the invention are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene. Group II metal phosphorodithioates also may be included in some of the lubricant. Examples of useful metal phosphorodithioates, include zinc dicyclohexylphosphorodithioate, zinc dioctylphosphorodithioate, barium di(heptylphenyl)phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol. When it is desired to formulate lubricating oils containing low amounts of phosphorus, such phosphorodithioiates should be avoided when possible.

Many of the above-mentioned auxiliary extreme pressure agents and corrosion-oxidation inhibitors also serve as antiwear agents. Zinc dialkylphosphorodithioates are well known examples.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purpose of this invention, techniques for their preparation and their uses are described in U.S. Pat. Nos. 2,387,501; 2,015,748; 2,655,479; 1,815,022; 2,191,498; 2,666,746; 2,721,877, 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henty T. Kerner (Noyes Data Corporation, 1976), pages 125–162.

The following are illustrative examples of the compositions of the present invention (including additive concentrates and lubricants). All parts and percentages are by weight of the total composition unless otherwise indicated.

| | Parts by Weight |
|---|---|
| Example 1 | |
| Magnesium dibutyldithiocarbamate | 5 |
| Product of Example I | 5 |
| Example 2 | |
| Magnesium dibutyldithiocarbamate | 5 |
| Product of Example IV | 3 |
| Example 3 | |
| Zinc dibutyldithiocarbamate | 10 |
| Product of Example V | 15 |
| Example 4 | |
| Zinc diamyldithiocarbamate | 10 |
| Product of Example VI | 10 |
| Example 5 | |
| Zinc diamyldithiocarbamate | 10 |
| Product of Example VI | 1 |
| Example 6 | |
| Zinc diamyldithiocarbamate | 10 |
| Product of Example VIII | 10 |
| Example 7 | |
| Zinc di(2-ethylhexyl)dithiocarbarmate | 10 |
| Product of Example XIII | 10 |
| Example 8 | |
| Molybdenum di(2-ethylhexyl) dithiocarbamate | 5 |
| Product of Example XV | 0.5 |
| Example 9 | |
| Mineral oil | 50 |
| Product of Example 1 | 50 |
| Example 10 | |
| Mineral oil | 70 |
| Composition of Example 8 | 30 |
| Example 11 | |
| Mineral Oil | 94 |
| Zinc dinonyldithiocarbamate | 3 |
| Product of Example V | 3 |
| Example 12 | |
| Mineral Oil | 93.6 |
| Zinc diamyldithiocarbamate | 3.90 |
| Product of Example VI | 2.0 |
| Reaction product of alkylene polyamine with polybutenyl (molecular weight of about 1700) succinic anhydride | 1.4 |
| Silicon anti-foam agent | 0.01 |
| Example 13 | |
| Mineral oil | 90.4 |
| Zinc diamyldithiocarbamate | 2.0 |
| Product of Example V | 2.0 |
| Reaction product of ethylene-polyamine with polyisobutenyl (molecular weight of about 1000) succinic anhydride | 4.1 |
| Basic magnesium petroleum sulfonate | 1.5 |
| Silicon anti-foam agent | 0.007 |
| Example 14 | |
| Mineral oil | 89.7 |
| Zinc diamyldithiocarbamate | 2.0 |
| Product of Example V | 2.0 |
| Reaction product of ethylene-polyamine with polyisobutenyl (molecular weight of about | 4.1 |

-continued

| | Parts by Weight |
|---|---|
| 1000) succinic anhydride | |
| Basic magnesium petroleum sulfonate | 1.5 |
| Alkylated arylamine | 0.7 |
| Silicon anti-foam agent | 0.007 |

Lubricating oil compositions containing the compositions of the invention as illustrated above exhibit improved corrosion-inhibiting, anti-wear and extreme pressure properties. When the lubricating oil compositions of this invention contain a sulfurized Diels-Alder adduct having a molar ratio of sulfur to adduct of less than 1:1, good nitrile seal compatability is obtained.

We claim:

1. A lubricating oil composition comprising a major amount of an oil of lubricating viscosity and a minor, property improving amount of an oil-soluble composition which comprises (A) at least one metal salt of at least one dithiocarbamic acid of the formula $$R_1(R_2)N\text{-}CSSH \qquad (I)$$

wherein $R_1$ and $R_2$ are each independently hydrocarbyl groups in which the total number of carbon atoms in $R_1$ and $R_2$ is sufficient to render the metal salt oil-soluble, and (B) at least one oil-soluble sulfurized Diels-Alder adduct of at least one dienophile with at least one aliphatic conjugated diene, wherein the weight ratio of (A) to (B) is in the range of from about 1:10 to about 50:1 and further wherein the lubricating oil composition contains less than about 0.1% by weight of phosphorous.

2. The composition of claim 1 wherein $R_1$ and $R_2$ of the dithiocarbamate are each independently alkyl, cycloalkyl, aryl, alkaryl or aralkyl groups.

3. The composition of claim 2 wherein $R_1$ and $R_2$ are alkyl groups containing at least 2 carbon atoms.

4. The composition of claim 1 wherein the metal of the metal salt (A) is a polyvalent metal.

5. The composition of claim 1 wherein the dienophile comprises an alpha, beta-ethylenically unsaturated aliphatic carboxylic acid ester, carboxylic acid amide, halide, nitrile, aldehyde, ketone, or mixtures thereof.

6. The composition of claim 1 wherein the aliphatic conjugated diene corresponds to the formula

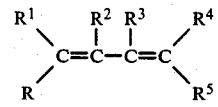

(II)

wherein R through $R^5$ are each independently selected from the group consisting of hydrogen, alkyl, halo, alkoxy, alkenyl, alkenyloxy, carboxy, cyano, amino, alkylamino, dialkylamino, phenyl, and phenyl substituted with one to three substituents corresponding to R through $R^5$, or R, $R^2$, $R^3$ and $R^5$ are as defined and $R^1$ and $R^4$ are alkylene groups joined together to form a cyclic diene.

7. The composition of claim 6 wherein $R^2$ and $R^3$ are hydrogen, and R, $R^1$, $R^4$ and $R^5$ are each independently hydrogen, halo, or lower alkyl.

8. The composition of claim 5 wherein the dienophile is further characterized in that it contains at least one, but not more than two —C(O)$OR_0$ groups wherein $R_0$ is residue of a saturated aliphatic alcohol of up to about 40 carbon atoms.

9. The composition according to claim 6 wherein the diene is piperylene, isoprene, methylisoprene, chloroprene, 1,3-butadiene, or mixtures thereof.

10. The composition according to claim 9 wherein the diene is 1,3-butadiene.

11. The composition according to claim 9 wherein said dienophile is an ester of acrylic acid or methacrylic acid.

12. The composition of claim 1 wherein the sulfurized Diels-Alder adduct (B) comprises the reaction product of sulfur and the Diels-Alder adduct in a molar ratio of from about 0.5 to 1 to about 10:1.

13. The composition of claim 12 wherein the molar ratio of sulfur to Diels-Alder adduct is less than about 4:1.

14. The composition of claim 12 wherein the molar ratio of sulfur to Diels-Alder adduct is less than about 1:1.

15. The composition of claim 1 wherein the phosphorus is present as a phosphorodithioate.

16. The lubricating oil composition of claim 1 containing substantially no phosphorus.

* * * * *